United States Patent [19]

Bloch

[11] 4,184,337

[45] Jan. 22, 1980

[54] METHOD AND APPARATUS FOR REGULATING A RESUPERHEATED STEAM TURBINE

[75] Inventor: Heinz Bloch, Nussbaumen, Switzerland

[73] Assignee: BBC Brown Boveri & Company Limited, Baden, Switzerland

[21] Appl. No.: 912,311

[22] Filed: Jun. 5, 1978

[30] Foreign Application Priority Data

Jun. 29, 1977 [CH] Switzerland ..... 7960/77

[51] Int. Cl.[2] ..... F01K 13/02

[52] U.S. Cl. ..... 60/660; 415/17

[58] Field of Search ..... 60/660, 663; 415/17, 415/30

[56] References Cited

U.S. PATENT DOCUMENTS

| | | | |
|---|---|---|---|
| 3,342,195 | 9/1967 | Wagner | 415/17 X |
| 3,913,329 | 10/1975 | Priluck | 60/660 |
| 4,005,581 | 2/1977 | Aanstad | 60/660 |

*Primary Examiner*—Allen M. Ostrager
*Assistant Examiner*—Stephen F. Husar
*Attorney, Agent, or Firm*—Werner W. Kleeman

[57] ABSTRACT

A method of, and apparatus for, regulating a resuperheated steam turbine wherein there is carried out a reference value-actual value comparison of the rotational speed and there is derived an adjustment or control magnitude from the reference value-actual value difference, this adjustment magnitude being infed to a regulation valve arrangement. There is derived from the resuperheated pressure a feedback magnitude which, as a function of time, yields to null and is coupled into a regulation circuit opposite to the adjustment magnitude.

8 Claims, 3 Drawing Figures

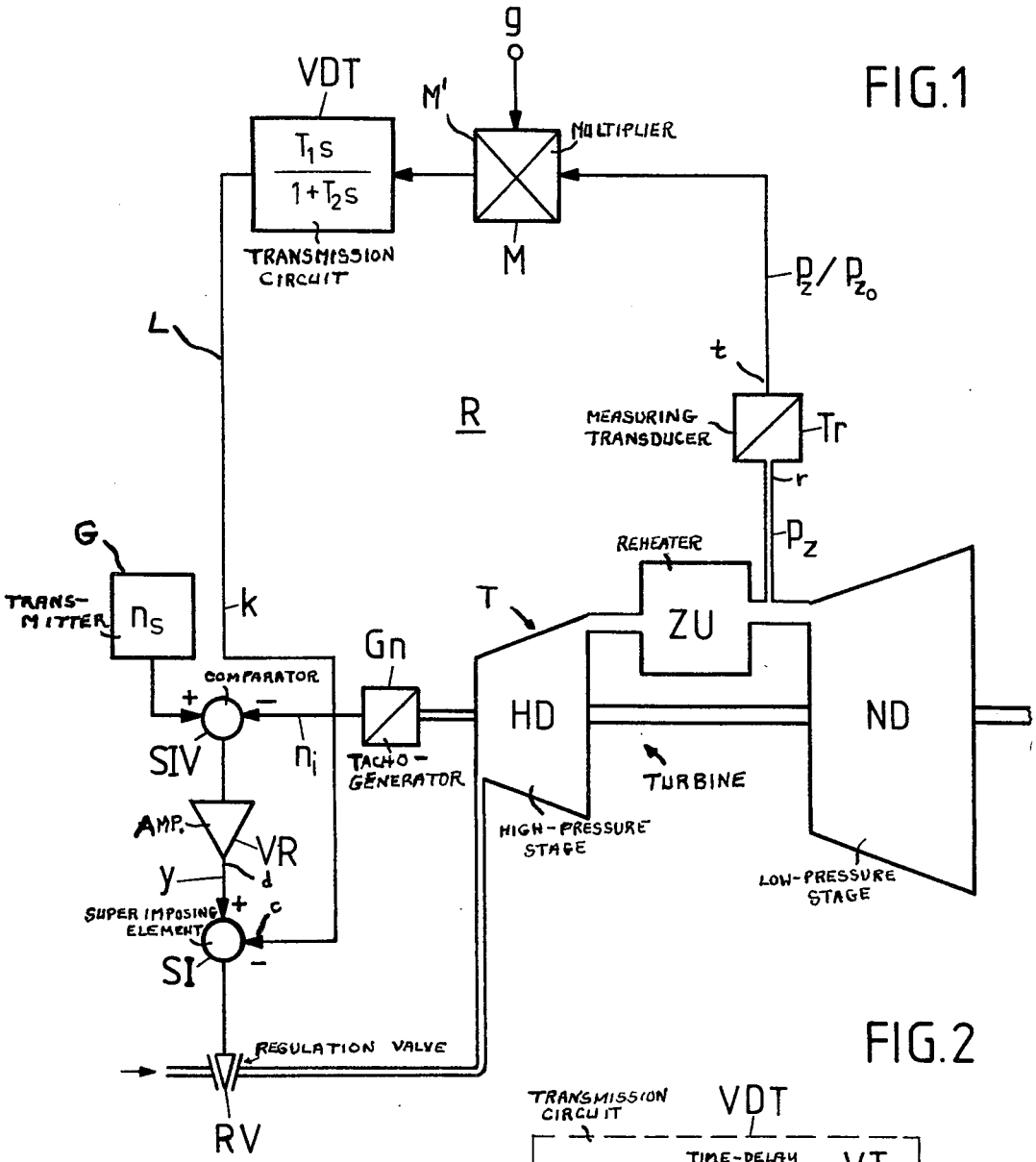
FIG.1
g
VDT
M'
MULTIPLIER
$\frac{T_1 s}{1+T_2 s}$
TRANSMISSION CIRCUIT
M
$p_z/p_{z_0}$
L
t
R
MEASURING TRANSDUCER
Tr
r
$p_z$
REHEATER
G
TRANS-MITTER
$n_s$
k
T
ZU
Gn
COMPARATOR
HD
ND
SIV
$n_i$
TACHO-GENERATOR
TURBINE
AMP.
VR
HIGH-PRESSURE STAGE
y
d
LOW-PRESSURE STAGE
SUPER IMPOSING ELEMENT
c
SI
REGULATION VALVE
RV
FIG.2
TRANSMISSION CIRCUIT
VDT
TIME-DELAY ELEMENT
VT
SU
SUPERIMPOSING ELEMENT
h
f
$\frac{1}{1+Ts}$
e
g

METHOD AND APPARATUS FOR REGULATING A RESUPERHEATED STEAM TURBINE

BACKGROUND OF THE INVENTION

The present invention relates to a new and improved method of regulating a resuperheated steam turbine, wherein there is carried out a reference value-actual value comparison of the rotational speed and there is derived from the reference value-actual value difference an adjustment or control magnitude which is infed to a regulation valve arrangement. The invention further pertains to a new and improved construction of apparatus for the performance of the aforementioned method aspects.

Steam turbine regulation generally encompasses a rotational speed regulation in the form of a direct rotational speed regulation with an essentially simple closed regulation circuit or in the form of a rotational speed regulation or frequency-output regulation, for instance, by means of an output regulation circuit having a cascade rotational speed regulation circuit. In both instances there is carried out a comparison of the actual value and reference value of the rotational speed and there is directly or indirectly derived from the difference of the reference value and actual value an adjustment or control magnitude.

As far as the stability and quality of the regulation is concerned, i.e., for a rapid and oscillation-free transition between different, steady state rotational speeds following the occurrence of surge-like disturbances, for instance due to load surges at the power supply network of an electrical generator coupled with the turbine, there is required an optimization of the transition behavior of the regulation or control circuit with appropriate damping. For this optimization there are available for complex regulation or control circuits different transmission elements having adjustable or selectable parameters. This is, however, associated with comparatively high circuit expenditure. In particular in the case of installations using mechanical or hydraulic, proportional-functioning rotational speed regulation or control difficulties can arise in attempting to obtain a rapid and oscillation-free rotational speed-transition or changeover behavior. This is especially so in the case of turbine-generator units which work both in the so-called island mode of operation as well as in compound operation.

SUMMARY OF THE INVENTION

Hence, with the foregoing in mind, it is a primary object of the present invention to provide a new and improved method of, and apparatus for, regulating a reheated or resuperheated steam turbine in a manner not associated with the aforementioned drawbacks and limitations of the prior art proposals.

Another important object of the present invention aims at providing a new and improved regulation or control method and apparatus suitable for the performance thereof, by means of which there can be obtained an advantageous rotational speed-transition behavior with comparatively low expenditure in the regulation or control equipment, specifically especially, even though not exclusively, with simple proportional-rotational speed-regulation, for instance for turbines working both in island and compound operation.

Now, in order to implement these and still further objects of the invention, which will become more readily apparent as the description proceeds, the method aspects of the present development are manifested by the features that there is derived a feedback magnitude, which (a) perodically yields to null, from the resuperheated pressure and such feedback magnitude is coupled into the regulation circuit opposite to the adjustment or control magnitude.

Not only is the invention concerned with the aforementioned method aspects but also relates to a new and improved apparatus for the performance thereof, which apparatus is manifested by the features that the output of a pressure-measuring transducer which is connected with the resuperheater or reheater is connected by means of a transmission circuit having a time-delay behavior which yields to null with an input of a superimposing element arranged in the regulation circuit, and which input works opposite to the adjustment or control magnitude.

In the case of a change in the adjustment or control magnitude caused by a disturbance, for instance a load jump or surge, the feedback magnitude functions in the manner of a negative feedback, in other words basically produces a corresponding change in the adjustment or control magnitude, however with a delay corresponding to the flow inertia of the resuperheater, i.e., the reheater or resuperheater-time constant. Owing to this inertia the pressure at the output of the resuperheater reacts with a time-delay constant in the order of magnitude of several seconds to an inlet side-pressure change of the preceding turbine stage, which, in turn, follows only with a slight time-delay the workings of the regulation valve arrangement under the action of the adjustment or control magnitude. Roughly speaking, the stabilizing effect of this feedback means that there is generally preferred the flow inertia of the resuperheater, and thus, the delayed reaction of the part of the rotational moment of the next turbine stage, which can lead to overshooting and possibly instability. This delayed reaction of the regulation or control loop can be more or less compensated by the available negative feedback. Thus, there is important the transition behavior of the feedback magnitude which yields to null, because in this way there is avoided an additional static component, i.e., an additional stationary regulation or control error.

The yielding transfer behavior of the feedback action can be simply realized by means of a differentiation transmission element (D-element) in the transmission circuit of the feedback branch or by means of an assembled together transmission element having a differentiating numerator term of its transfer function. Generally, the transmission circuit furthermore contains a series time-delay element, and specifically, according to an advantageous simple construction of the invention one which is of the first order. With appropriate dimensioning of the corresponding time-delay constant there can be achieved with such a simple transmission or transfer element a surprisingly good approximation to a periodic damping. As extensive tests have shown there can be used for the time-delay constant values corresponding to the resuperheater time-constant and above.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a principle functional diagram of a two-stage steam turbine having a reheater or resuperheater and a rotational speed-regulation circuit with feedback of the resuperheater pressure;

FIG. 2 illustrates a modified part of the circuitry of the arrangement of FIG. 1.

DETAILED DESCRIPTION OF THE PREFERRED EMBODIMENTS

Figure 3:
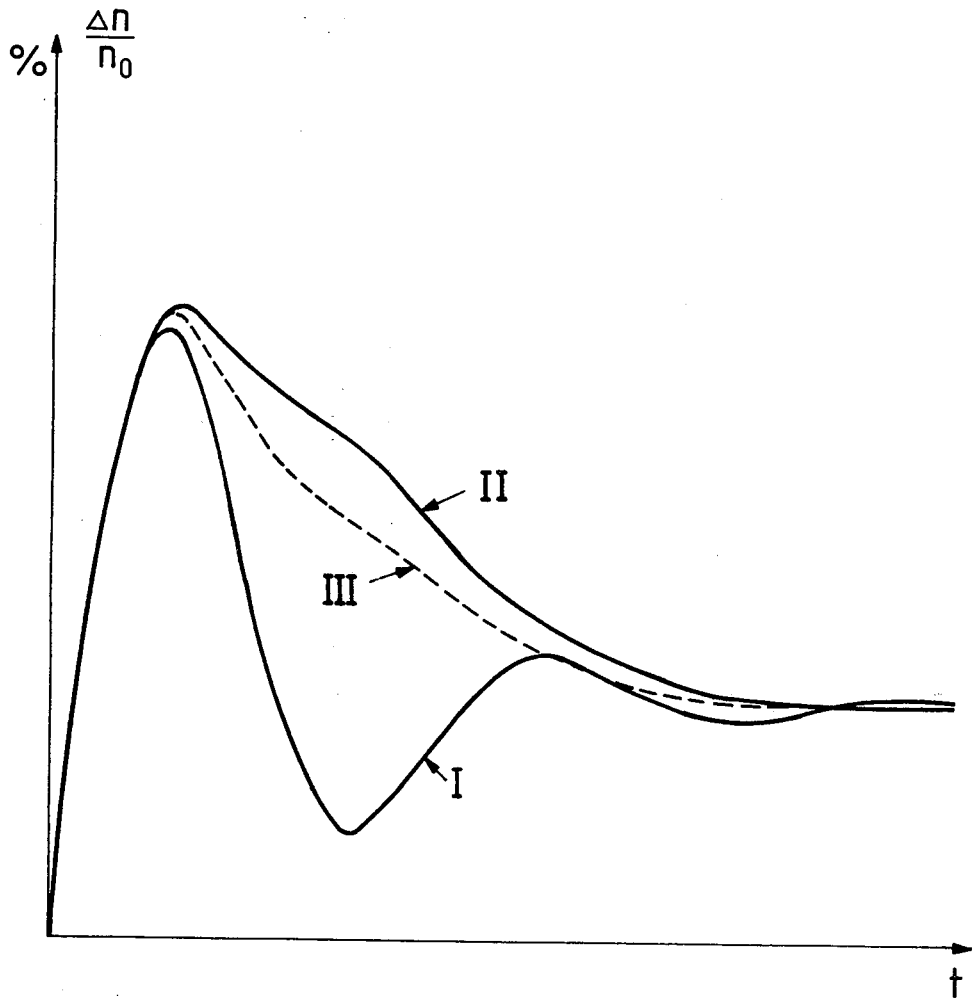
FIG. 3 is a graph which plots the rotational speed change $\Delta$ n related to the rated rotational speed $n_o$ as a function of time as the response to a surge-like reduction of the turbine output (negative load surge).

Describing now the drawings, the turbine T generally indicated in FIG. 1 will be seen to comprise a high-pressure stage HD which is fed with steam by means of a regulation valve arrangement RV. Following the high-pressure stage HD is a reheater or resuperheater ZU and thereafter a low-pressure stage ND which is fed by the reheater or resuperheater ZU. Connected with the turbine as the regulation path or loop is a tachogenerator Gn serving as a measuring element and which converts the rotational speed of the turbine T into an appropriate actual value signal $n_i$. This actual value signal $n_i$ is subtractively superimposed upon a reference value signal $n_s$ delivered by an appropriate transmitter G in a superimposing element SIV functioning as a reference value-actual value comparator. The resultant reference value-actual value difference, in the embodiment under consideration, is directly converted by means of a simple proportional regulation in a regulation or control amplifier VR into an adjustment or control magnitude y which controls, for instance, the electro-hydraulic drive of the regulation valve arrangement RV.

Such a rotational speed-regulation circuit, with a negative load surge, typically carries out an equalization or compensation process, as such has been indicated by the curve I in FIG. III. The rotational speed change $\Delta n/n_o$ related to the rated rotational speed $n_o$, following pronounced oscillations, which typically last for about 15 seconds, transforms into an essentially constant or stationary value governed by the statics of the regulation circuit. The maximum overshot amplitude of $\Delta n/n_o$ approximately attains the 2.5-fold value of the steady state or stationary rotational speed change. Such type transition or transfer behavior is especially undesired, or, in fact, impermissible for island operation of a larger turbo-generator unit in consideration of the corresponding field spider or revolving field oscillations of the generator and frequency fluctuations in the load network.

To counteract this undesirable effect there is utilized the feedback, indicated in FIG. 1, of a magnitude $p_z/p_{zo}$ derived at the output side or output t of a measuring transducer Tr, of the resuperheater pressure $p_z$ related to its rated value $p_{zo}$ in the regulation circuit and having an opposite effect to the adjustment or control magnitude. The resuperheater pressure $p_z$ appears at the input side r of the measuring transducer Tr. The corresponding output signal $p_z/p_{zo}$ of the transducer Tr is converted into a feedback magnitude k in the feedback branch or loop R of the regulation circuit. This feedback magnitude k is formed by a multiplier M having an adjustable gain or amplification factor g and acting as a porportional amplifier M' and connected in series with a transmission or transfer circuit VDT. This feedback magnitude k is infed by the line L to an input c of an additional superimposing element SI connected with the output d of the regulation amplifier VR. This input c acts opposite to the polarity of the reference value signal $n_s$ and therefore to that of the adjustment or control magnitude y.

The transmission or transfer circuit VDT possesses transfer or transmission function of the type $T_1.s/(1+T_2.s)$, wherein s is the Laplace operator and $T_2$ represents the time-delay constant of the time-delay element of the first order of the denominator. Apart from this delay, which determines the time course of the feedback magnitude during a starting portion of the transition, the differentiating numerator of the transfer function brings about a transfer or transition behavior of the feedback magnitude which yields towards null. In this way there is avoided a static error, i.e., an additionally remaining regulation deviation. The differential time-constant $T_1$ in the numerator generally corresponds at least approximately to the reheater or resuperheater time-constant.

The curve II of FIG. 3 shows the effect of the feedback branch for the following parameter settings: amplification factor or gain g amounts to ½, time-constant $T_2$=reheater or resuperheater-time-constant. There will be apparent therefrom an appreciable improvement in the ransition behavior with practically complete avoidance of oscillations, and specifically worthy of mention, practically without any increase of the maximum rotational speed elevation in comparison to the maximum overshot amplitude of the curve I. A still further extensive optimization of the parameter setting with g=1.5 and again $T_2$=resuperheater time-constant is shown by the curve III which is not only free of oscillations, but rather assumes appreciably earlier than the curve II the new stationary or steady state rotational speed value, and therefore, corresponds approximately to the strived for ideal case of the aperiodic damping. Amplification values in a range between 1 and 2 are thus to be preferred, especially those in the range of about 1.5. Detailed tests, which are not here further discussed, additionally lead to the result that the time-delay constant T should not fall below the resuperheater time-constant, rather more likely should exceed such.

Now, in FIG. 2 there is shown a more simply realizable constructional embodiment of the transfer or transmission circuit VDT insofar as the circuit expenditure is concerned, and having a transition behavior yielding to null while utilizing a simple time-delay element VT. According to this arrangement the input e and the output f of the time-delay element VT are connected to a respective one of two mutually opposite inputs g and h of a subtractive superimposing element SU, the output j of which forms the output of the transfer or transmission circuit VDT, and thus, delivers the feedback magnitude k. As an analytic analysis of the transfer or transmission function of the illustrated parallel circuit with substractive superimposing will reveal, there is likewise realized a yielding time-delay element of the first order (DT-element) without having to provide in the circuit design a differentiation element. In this regard there is automatically realized the relationship $T_1=T_2=T$.

While there are shown and described present preferred embodiments of the invention, it is to be distinctly understood that the invention is not limited thereto, but may be otherwise variously embodied and practiced within the scope of the following claims. Accordingly,

What I claim is:

1. A method of regulating a resuperheated steam turbine, having a resuperheater, comprising the steps of:

comparing a reference value and actual value of the rotational speed of the steam turbine;

deriving a difference from the reference value and actual value comparison and constituting an adjustment magnitude;

feeding said adjustment magnitude to a regulation valve arrangement of a regulation circuit;

deriving from the resuperheater pressure a feedback magnitude which yields towards null as a function of time; and coupling said feedback magnitude opposite to the adjustment magnitude into the regulation circuit.

2. An apparatus for regulating a resuperheated steam turbine comprising:

a steam turbine;

a resuperheater operatively connected with the steam turbine;

a regulation circuit having a superimposing element having an input and an output;

said regulation element further containing means producing an adjustment magnitude constituting the difference between a reference value and actual value of the rotational speed of the steam turbine and which adjustment magnitude is infed to said input of said regulation circuit;

a pressure-measuring transducer having an input and an output;

a transmission circuit, having a time-delay behavior yeilding to null;

said pressure-measuring transducer being connected with the resuperheater;

the output of the pressure-measuring transducer being connected with the input of the superimposing element arranged in the regulation circuit by means of the transmission circuit and which input of said superimposing element acts opposite to the adjustment magnitude.

3. The apparatus as defined in claim 2, wherein:

said transmission circuit comprises a differentiation and time-delay transmission circuit of the first order and having a differential time-constant which is at least approximately equal to the time-constant of the resuperheater.

4. The apparatus as defined in claim 3, wherein:

the transmission circuit has a time-delay constant which is at least equal to the time-constant of the resuperheater.

5. The apparatus as defined in claim 3, further including:

a feedback branch connected with the pressure-measuring transducer which carries a pressure signal related to the rated value of the resuperheater pressure; and said feedback branch containing a proportional amplifier having an amplification factor related to the value of the adjustment magnitude and amounting to a value between 1 and 2.

6. The apparatus as defined in claim 5, wherein:

said amplification factor amounts to approximately 1.5.

7. The apparatus as defined in claim 4, further including:

a feedback branch connected with the measuring transducer which carries a pressure signal related to the rated value of the resuperheater pressure; and said feedback branch having a proportional amplifier with an amplification factor related to the value of the adjustment magnitude and amounting to a value between 1 and 2.

8. The apparatus as defined in claim 7, wherein:

said transmission circuit comprises a time-delay element having an input and an output;

a substractive transmission element having two opposite inputs and an output;

the input and the output of the time-delay element of the transmission circuit being coupled with a respective one of the two opposite inputs of the subtractive transmission element; and the output of said subtractive transmission element being coupled opposite to the adjustment magnitude in the regulation circuit.

* * * * *